United States Patent [19]

Ganowsky et al.

[11] 4,151,499

[45] Apr. 24, 1979

[54] ROTARY SOLENOID WITH INDIRECTLY COUPLED OUTPUT SHAFT

[75] Inventors: Raymond J. Ganowsky, St. George, Utah; Alvin P. Fenton, Oostburg, Wis.

[73] Assignee: Kohler Company, Kohler, Wis.

[21] Appl. No.: 770,619

[22] Filed: Feb. 22, 1977

[51] Int. Cl.[2] ..... H01F 7/14

[52] U.S. Cl. ..... 335/272; 335/279; 123/119 F

[58] Field of Search ..... 335/124, 125, 272, 279, 335/281; 123/119 F

[56] References Cited

U.S. PATENT DOCUMENTS

| | | | |
|---|---|---|---|
| 2,767,357 | 10/1956 | Naybor | 335/279 X |
| 3,001,107 | 9/1961 | Rhodes | 335/272 |
| 3,278,875 | 10/1966 | McDonough | 335/272 |
| 3,978,835 | 9/1976 | Fenton | 123/119 F |

FOREIGN PATENT DOCUMENTS

| | | | |
|---|---|---|---|
| 1102811 | 2/1968 | United Kingdom | 335/272 |

*Primary Examiner*—George Harris

*Attorney, Agent, or Firm*—Brown & Martin

[57] ABSTRACT

A rotary solenoid having an output shaft that is indirectly coupled to the rotor or armature of the solenoid, for rotation independently of or coupled to the solenoid. In one application of the solenoid the shaft is rotated through a limited range by a bimetallic torsional element, which is overridden by operation of the solenoid to increase the range of rotation. The range of travel can be limited by a disc having a slotted peripheral flange between the solenoid rotor and the output shaft. The armature has an integral hub and spaced poles with the pole pieces being rotatably positionable within the space between the hub and poles. Structure of the unit is very simple and all parts are readily accessible for adjustment and servicing.

10 Claims, 11 Drawing Figures

ROTARY SOLENOID WITH INDIRECTLY COUPLED OUTPUT SHAFT

BACKGROUND OF THE INVENTION

Rotary solenoids are available in various forms for providing rotary motion in limited repeatable steps with a positive drive action. The motion may be forward and back, or accumulative in successive steps, but each action is usually of equal amount. The action may be a simple torque drive between magnetic poles, or a linear to rotary conversion through cams or similar means. In each instance the rotation is limited to the specific range of travel for which the mechanism is designed.

SUMMARY OF THE INVENTION

The rotary solenoid described herein has an output shaft which is rotatable independently of the solenoid rotor, and is driven through an initial range of rotation by torsional element axially mounted on the output shaft. The solenoid rotor carries a drive pin which engages the torsional element to rotate the output shaft in a first angular direction when the solenoid is energized. A spring is coupled to the output shaft for biasing the output shaft for rotation in the opposite angular direction when the solenoid is not energized. A disc having slotted peripheral flange is mounted on the output shaft to engage the drive pin and the torsional element in the slot. The length of the slot controls the range of travel under the influence of the independent actuating means. Operation of the solenoid rotates the rotor, causing the drive pin to engage the torsional element and turn the output shaft beyond the limit of movement of the independent actuating means.

One particular application of the unit is in the operation of the choke in an internal combustion engine. The output shaft is connected to the choke so that, when the bimetallic element is warm, as in normal running of the engine, the choke is fully open. When the engine is cold, the bimetallic element moves the output shaft independently of the solenoid to hold the choke partially closed. When the engine is started the solenoid is actuated, as by connection through the starting switch, to override the bimetallic element and provide full choking momentarily while the starting switch is held on. When the solenoid is off, the output shaft is again coupled to the bimetallic element.

The solenoid comprises a magnetically permeable stator having an axial hub and radially spaced poles. The poles and hub are aligned axially, forming an enclosed space therebetween. An energizing coil is positioned in said space. A rotor is axially, rotatably mounted on the hub, and has diametrically opposed pole pieces that are positionable in movement of the rotor, completely within the space defined by the poles and the axial hub. The rotor is made of non-metallic material. Thus, the magnetically permeable material of the pole pieces are completely enclosed within the volume defined by the hub and the poles. The spacing between the poles and the hub, and the width of the pole pieces, are such that a very close tolerance exists that minimizes loses in the magnetic field. This provides maximum efficiency of the magnetic circuit while virtually eliminating axial thrust of the rotary elements that otherwise rob a rotary solenoid of output torque through frictional loss.

The structure is very simple and some parts can be molded from plastic to reduce cost, since tolerances are not particularly critical. The mechanism is completely enclosed in a protective housing and is readily accessible for servicing.

The primary object of this invention, therefore, is to provide a new and improved rotary solenoid with an indirectly coupled output shaft.

Another object of this invention is to provide a rotary solenoid having an output shaft which is driven through a limited range of rotation by actuating means independent of the solenoid.

Another object of the invention is to provide a rotary solenoid in which energization of the solenoid overrides the independent actuating means.

A further object of this invention is to provide a rotary solenoid which is adaptable to simple low cost construction.

A further object of this invention is to provide a new and improved rotary solenoid having a non-magnetic rotor that positions pole pieces completely within the magnetic circuit in a manner that substantially eliminates axial friction and the bearings required to absorb the axial friction.

Other objects and advantages will be apparent in the following detailed description, taken in conjunction with the accompanying drawings, in which.

DESCRIPTION OF THE PREFERRED EMBODIMENT

Figure 1:
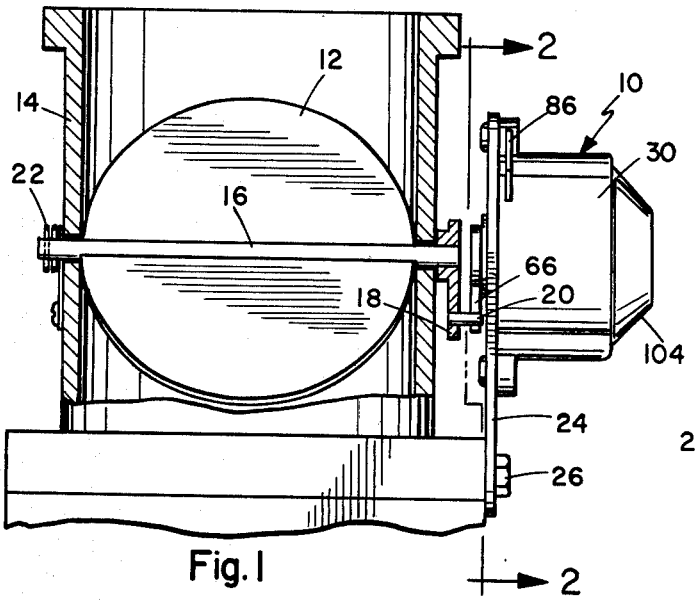
FIG. 1 illustrates the solenoid unit mounted on a typical choke structure.

The solenoid unit 10 is illustrated as being used to actuate a choke in an internal combustion engine, as a particular example of use. However, the unit may be used for other purposes with a variety of independent actuating means.

In the installation as shown, a choke valve 12 is mounted in an intake 14 on a choke shaft 16, which has an external actuating arm 18 with a projecting coupling pin 20. A return spring 22 is coupled to choke shaft 16 to hold the choke in a normally open position.

Figure 2:
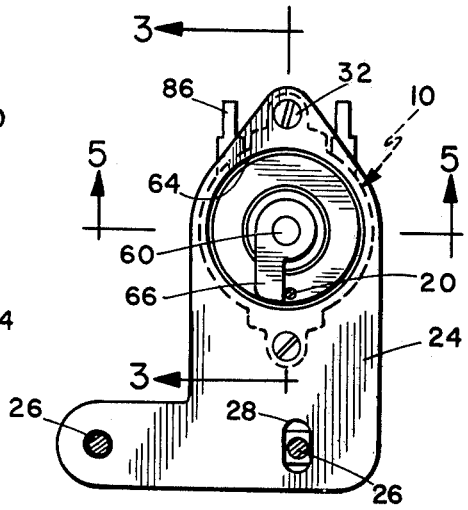
FIG. 2 is a view taken on line 2—2 of FIG. 1.
Figure 3:
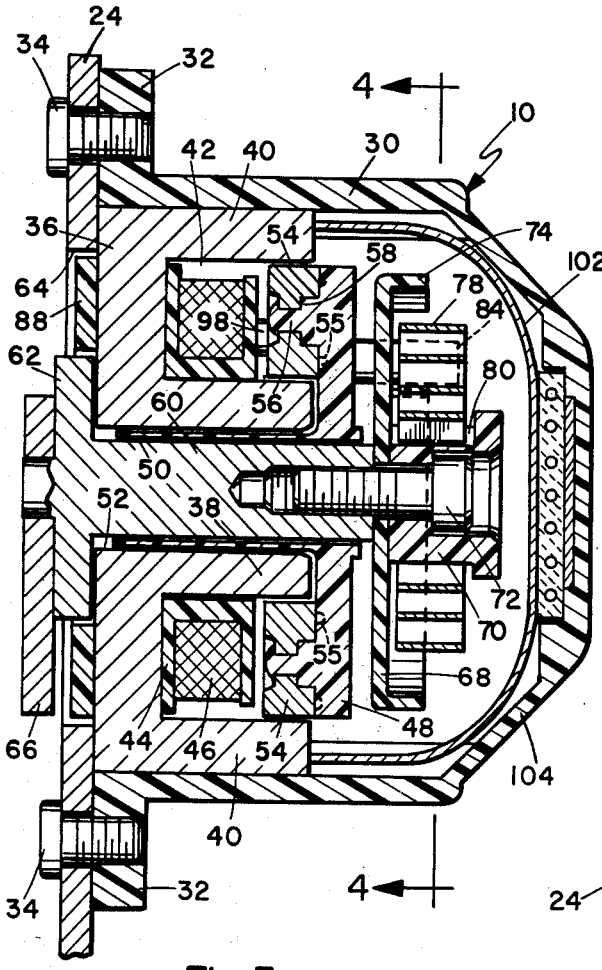
FIG. 3 is an enlarged sectional view taken on line 3—3 of FIG. 2.

The solenoid unit 10 is held on a mounting bracket 24 which is secured to the intake 14 by bolts 26. One of the bolts holes 28 may be elongated for adjustment as in FIG. 2.

Figure 6:
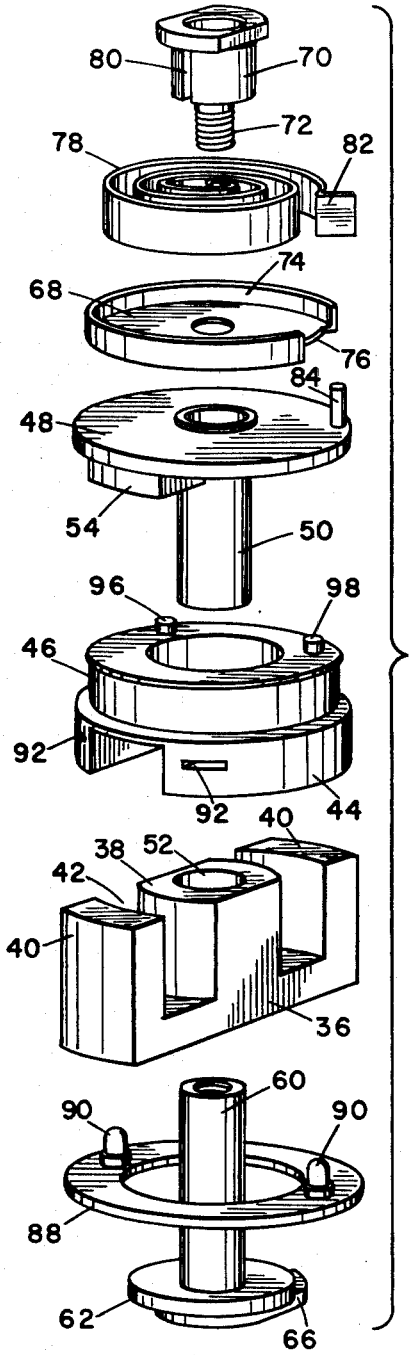
FIG. 6 is an exploded perspective view of the mechanism.
Figure 5:
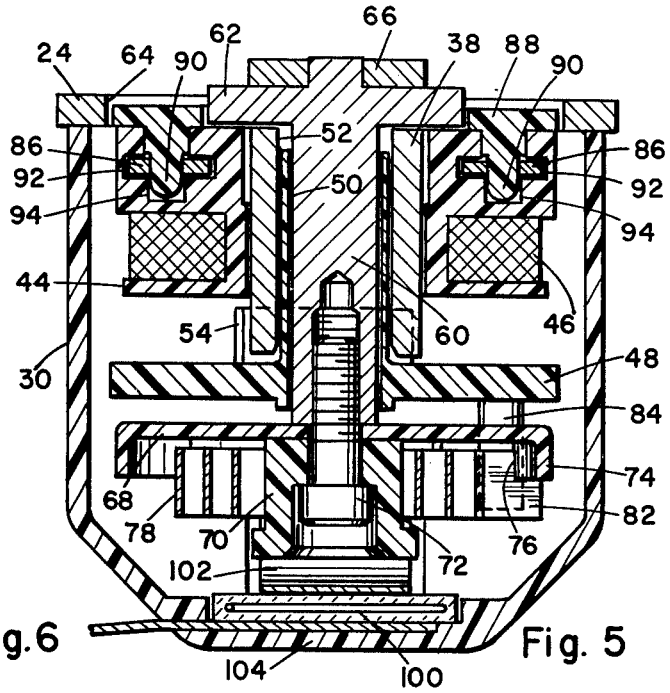
FIG. 5 is an enlarged sectional view taken on line 5—5 of FIG. 2.

The solenoid mechanism is enclosed in a housing 30, having lugs 32 for attachment to bracket 24 by means of screws 34. In the housing 30 is a stator 36 of iron or other magnetically permeable material. The stator is a diametrical chordal portion of a cylinder and has a central axial hub 38 and axially extending poles 40 at opposite ends, with a circular channel 42 therebetween, as in FIG. 6. Fixed over hub 38 is a bobbin 44 carrying a solenoid coil 46, the bobbin straddling stator 36 and the coil being recessed in channel 42. Mounted on stator 36 is rotor 48 of non-magnetic material, such as plastic, the rotor comprising a disc with an axially projecting sleeve 50, which is rotatable in an axial bore 52 through hub 38. Fixed to rotor 48 are diametrically opposed pole pieces 54, which can swing with minimum clearance through channel 42, and are essentially recessed within the depth of the channel. As illustrated, each pole piece 54 is held on a rivet 56 formed integrally with rotor 48, the rivet having a non-circular base 58 to hold the pole piece in alignment.

Figure 10:
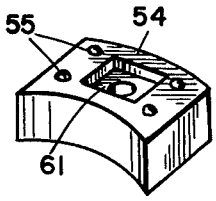
FIG. 10 is a perspective view of a pole piece.
Figure 11:
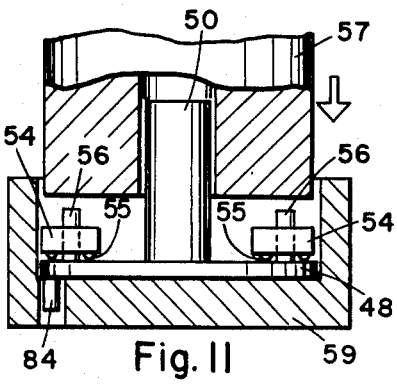
FIG. 11 is a side view, partly in section, of the fixture for ultrasonicly welding the pole piece to the rotor.

In addition, the pole pieces have multiple projections 55, see FIG. 10, that project into the surface of the rotor, thus assuring no movement of the pole pieces relative to the rotor. Referring to FIG. 11, the rotor 48 and the pole pieces 54 are positioned in fixture 59. Then the ultrasonic welder 57 moves in the direction of the arrow to spread the end of rivet projection 56 into the square recess 61 of pole piece 54, and also drives pole piece 54 into abutment with the surface of rotor 48 with projections 55 embedded in the rotor. This prevents rotation of the pole pieces with a simple connection.

The output shaft 60 is axially rotatable in sleeve 50 and has a flanged output end 62 projecting through an opening 64 in bracket 24. Fixed to flanged end 62 is an output arm 66 which engages coupling pin 20 to urge the choke valve 12 to closed position. The inner end of output shaft 60 projects beyond rotor 48 and fixed thereto is a coupling disc 68. A retaining boss 70 is mounted in the center of coupling disc 68 and both are secured by a clamp screw 72 threaded axially into the output shaft 60. Coupling disc 68 has an annular flange 74 in which is a circumferentially extending slot 76, the length of which determines the range of movement independent of the solenoid action.

A bimetallic element 78, in the form of a spiral ribbon, has its inner end held in a groove 80 in retaining boss 70. The outer end of bimetallic element 78 has a radially extending tongue 82 which projects beyond flange 74 through slot 76. Fixed to the peripheral portion of rotor 48 is a drive pin 84, which extends axially through slot 76 to engage either the flange 74 or tongue 82.

Electrical connections to coil 46 are made through terminal bars 86, which are inserted through slots 92 in bobbin 44 and extend outwardly through housing 30. The ends of the coil are soldered or otherwise connected to the terminal bars, which are secured in place by a retaining ring 88. The retaining ring fits concentrically around flanged end 62 against the outer face of stator 36, and has integral pins 90 which are press fitted into sockets 94 in the bobbin and pass through the terminal bars 86 to secure the assembly.

Figure 4:
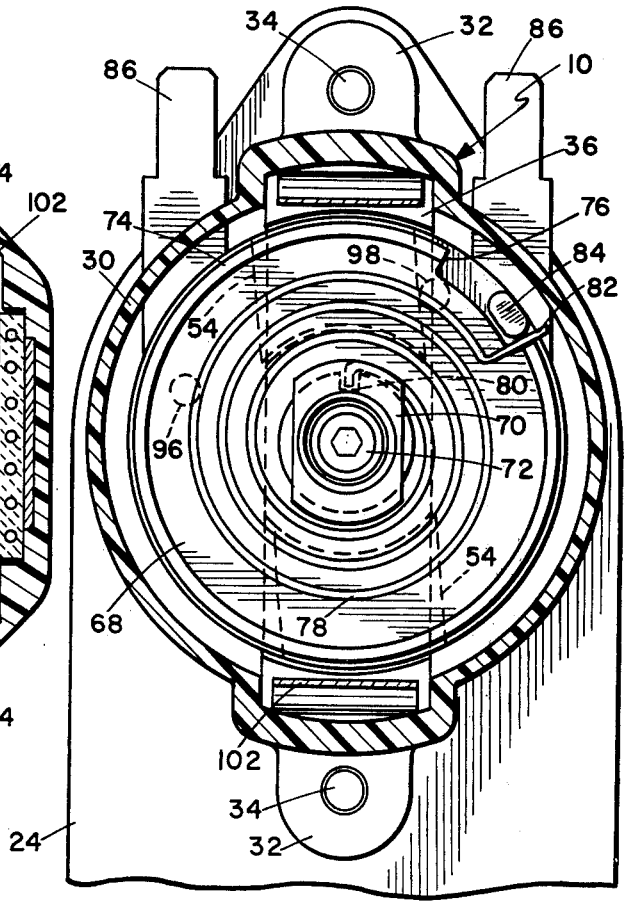
FIG. 4 is a sectional view taken on line 4—4 of FIG. 3.
Figure 7:
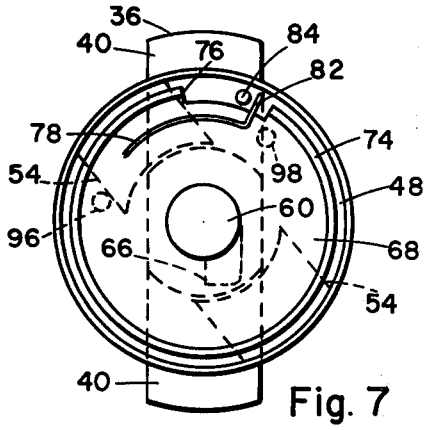
FIGS. 7 through 9 illustrate diagrammatically, three positions of the mechanism.
Figure 9:
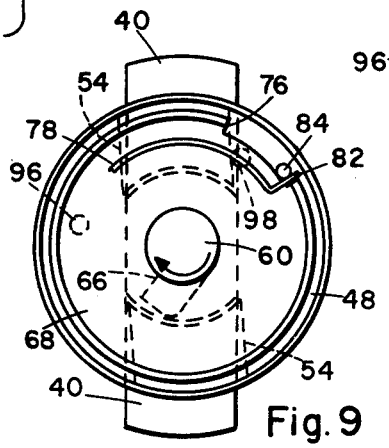

In the non-energized condition of the solenoid, rotor 48 is positioned with the pole pieces 54 angularly offset from stator poles 40, as in FIG. 7. In the energized position the magnetic field through stator 36 pulls the pole pieces 54 into diametrical alignment with poles 40, as in FIGS. 4 and 9. Since the pole pieces 54 are contained within the depth of the stator 36, the magnetic circuit is closed without any friction causing axial load on the rotor. Rotation of the rotor is limited in the two positions by fixed stops 96 and 98, projecting from bobbin 44 to engage one of the pole pieces 54.

Figure 8:
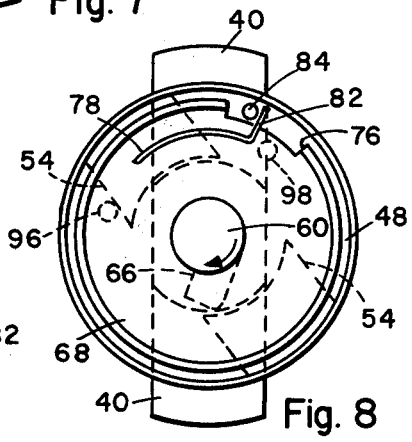

In the normal running condition of an engine, when no choke action is required, the bimetallic element 78 is warm and tongue 82 is engaged with the drive pin 84, as shown in FIG. 7. When the engine is cold, prior to starting, the bimetallic element 78 is coiled to bring tongue 82 against drive pin 84, as in FIG. 8. The resultant torque rotates coupling disc 68 and output shaft 60, forcing output arm 66 against coupling pin 20 for partial closing of the choke. This is also the idle position until the bimetallic element is warmed by the engine and the force of the tongue 82 against the drive pin 84 causes the output shaft 60 to rotate as the bimetallic element expands.

To provide full choking when starting the engine, the solenoid is actuated, preferably by connection through the existing ignition switch. The rotor 48 is rotated by the magnetic field of the solenoid until the pole piece 54 engages stop 98, as in FIG. 9. As this occurs, drive pin 84, in engagement with tongue 82, causes output shaft 60 to be turned, driving the choke valve 12 to full choke position. By coupling the solenoid to the ignition switch, full choking is held only momentarily during initial starting. Upon release of the ignition switch, the solenoid is de-energized and the mechanism is returned to the partial choke position of FIG. 8 by the choke return spring 22, acting through coupling pin 20 against output arm 66. As the engine warms up, bimetallic element 78 expands and the choke return spring 22 opens the choke valve to normal running position.

In an engine installation in a cold climate, where the engine heat might not affect the bimetallic element sufficiently, or where the engine operation is intermittent and partial choking is not necessary after each start, a heater 100 may be installed in the unit. The heater is illustrated as a resistance type element seated in the cap portion 104 of housing 30, and held in place by a spring bow 102. Any other suitable arrangement may be used. The heater maintains sufficient heat in the unit to keep the bimetallic element out of engagement with the rotor. When the engine is to be shut off for any considerable period, the heater would be turned off so that normal cold starting would occur.

The output shaft of the unit thus operates independently of the solenoid by action of the bimetallic element, the solenoid providing an override when required. Actuating means other than a thermally responsive element may be used in some installations, depending on requirements. It should also be understood that the unit is not limited to operation of a choke, but is applicable to other uses where the combined action of a solenoid and other means could be useful.

Having described my invention, I now claim:

1. A rotary solenoid, comprising a stator; a rotor; and an energizing coil; wherein the rotor is rotatable between a first position when the coil is energized and a second position when the coil is not energized, said rotary solenoid further comprising an output shaft axially rotatably mounted through the rotor and the stator and having an output end projecting from one end of the solenoid;

a torsional element axially mounted on the output shaft, having an inner end fixedly connected to the output shaft, and having a tongue at an outer end extending in a direction that is approximately radial from the output shaft;

a drive pin mounted on the rotor for engaging the tongue of the torsional element for rotating the output shaft in a first angular direction when the rotor is rotated from the second position to the first position, and to be engaged by the tongue when the output shaft is rotated in the opposite angular direction to enable the rotor to be rotated to the second position; and means coupled to the output shaft for biasing the output shaft for rotation in the opposite angular direction when the coil is not energized;

whereby the output shaft is rotated independently of the rotor by the torsional element.

2. A rotary solenoid according to claim 1, further comprising a disc having a peripheral flange with a circumferentially extending slot therein, wherein the disc is fixedly mounted on the output shaft for engaging the tongue and the drive pin through the slot for limiting said independent rotation of the output shaft.

3. A rotary solenoid according to claim 1, wherein the stator is a magnetically permeable solenoid stator having an axial hub and integrally connected and diametrically opposed poles radially spaced from the hub and in axial alignment therewith;

the energizing coil is positioned on the stator in the space between the hub and the poles;

the rotor includes a non-magnetic material disc axially rotatably mounted on the hub and having diametrically opposed pole pieces spaced for passage between the hub and the poles; with the entire structure of the pole pieces passing within the enclosed volume of the hub and the poles, thereby substantially reducing axial forces on the rotor.

4. A rotary solenoid according to claim 3, wherein the pole pieces are connected to the rotor for rotational movement with the rotor, circumferentially in and out of the space between the hub and the poles, and the pole pieces are positioned axially adjacent to the coil.

5. A rotary solenoid according to claim 3, wherein the pole pieces have a radial width only slightly smaller than the space between the axial hub and the poles.

6. A rotary solenoid according to claim 5, wherein one side of the pole pieces has multiple projections, that are fused into the surface of the rotor with said projections preventing the pole pieces from movement relative to said rotor.

7. A rotary solenoid according to claim 1, further comprising fixed stops coupled to the stator for engagement with the rotor to limit the rotation thereof between said first and second positions.

8. A rotary solenoid, comprising a stator; a rotor; and an energizing coil; wherein the rotor is rotatable between a first position when the coil is energized and a second position when the coil is not energized, said rotary solenoid further comprising an output shaft axially rotatably mounted through the rotor and the stator and having an output end projecting from one end of the solenoid;

a thermally responsive torsional element axially mounted on the output shaft, having an inner end fixedly connected to the output shaft, and having a tongue at an outer end extending in a direction that is approximately radial from the output shaft;

a drive pin mounted on the rotor for engaging the tongue of the torsional element for rotating the output shaft in a first angular direction when the rotor is rotated from the second position to the first position, and to be engaged by the tongue when the output shaft is rotated in the opposite angular direction to enable the rotor to be rotated to the second position; and means coupled to the output shaft for biasing the output shaft for rotation in the opposite angular direction when the coil is not energized;

whereby the output shaft is rotated independently of the rotor when the thermally responsive torsional element expands or contracts in response to changes in temperature.

9. A rotary solenoid according to claim 8, further comprising a disc having a peripheral flange with a circumferentially extending slot therein, wherein the disc is fixedly mounted on the output shaft for engaging the tongue and the drive pin through the slot for limiting the rotation of the output shaft in response to said expansion or contraction of the torsional coil.

10. A rotary solenoid according to claim 8, further comprising fixed stops coupled to the stator for engagement with the rotor to limit the rotation thereof between said first and second positions.

* * * * *

UNITED STATES PATENT AND TRADEMARK OFFICE

CERTIFICATE OF CORRECTION

PATENT NO. : 4,151,499

DATED : April 24, 1979

INVENTOR(S) : Raymond John Ganowsky

It is certified that error appears in the above-identified patent and that said Letters Patent are hereby corrected as shown below:

On the title page, after the designation of "Kohler Company, Kohler, Wis." as "Assignee", insert:

-- Kohler Company, Kohler, Wisconsin; a part interest --.

Signed and Sealed this

*Eleventh* Day of *December 1979*

[SEAL]

*Attest:*

SIDNEY A. DIAMOND

*Attesting Officer*

*Commissioner of Patents and Trademarks*